US005719602A

United States Patent [19]

Hackleman et al.

[11] Patent Number: 5,719,602

[45] Date of Patent: Feb. 17, 1998

[54] CONTROLLING PWA INKJET NOZZLE TIMING AS A FUNCTION OF MEDIA SPEED

[75] Inventors: David E. Hackleman, Monmouth; William A. Buskirk, Albany, both of Oreg.

[73] Assignee: Hewlett-Packard Company, Palo Alto, Calif.

[21] Appl. No.: 375,743

[22] Filed: Jan. 20, 1995

[51] Int. Cl.[6] ..... B41J 29/38; B41J 2/155; B41J 2/01

[52] U.S. Cl. ..... 347/14; 347/42; 347/104; 347/188

[58] Field of Search ..... 347/12, 14, 42, 347/104, 188, 13

[56] References Cited

U.S. PATENT DOCUMENTS 4,176,013 11/1979 Hoskins et al. ..... 347/37

5,089,712 2/1992 Holland ..... 250/557

5,398,053 3/1995 Hirosawa et al. ..... 347/13

*Primary Examiner*—Huan H. Tran

*Assistant Examiner*—Craig A. Hallacher

[57] ABSTRACT

A page-wide-array ("PWA") inkjet printer includes a printer element defining a printhead with thousands of nozzles spanning a pagewidth. A media sheet travels along a media path adjacent to the printhead to receive character or graphic markings. Typically, a media sheet accelerates from rest to a constant velocity. To optimize print speed nozzle timing is controlled to respond to changes in media velocity. Printing occurs while the media is accelerating and while traveling at a constant velocity. A sensor positioned in fixed relation to a PWA printer element detects the media's actual velocity. Actual velocity is fed back to a printhead controller which compares actual velocity to a rated constant velocity. If actual velocity is slower than the rated velocity, then nozzle timing is adjusted to be slower than a rated timing. If actual velocity is faster than rated velocity, then nozzle timing is adjusted to be faster than the rated timing.

12 Claims, 4 Drawing Sheets

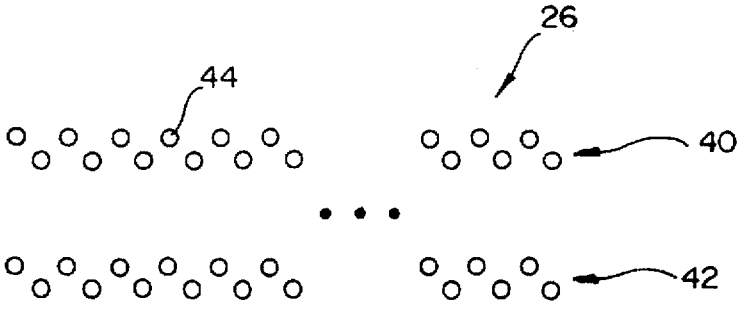
FIG. 2
FIG. 3
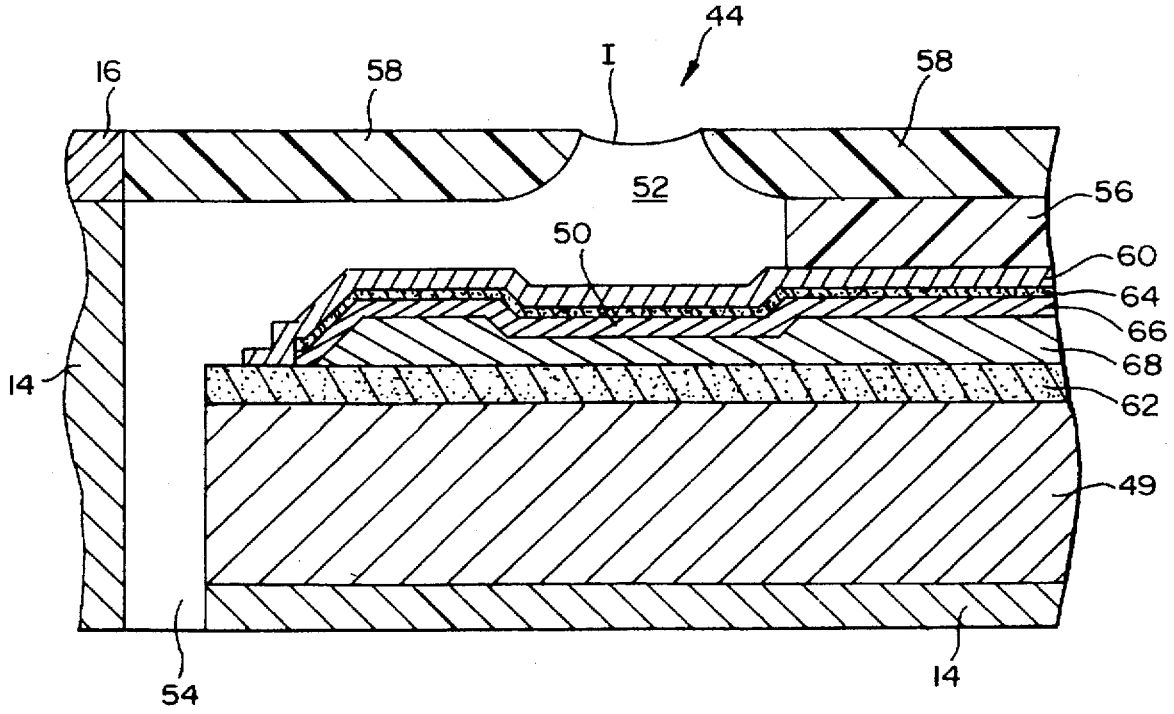

CONTROLLING PWA INKJET NOZZLE TIMING AS A FUNCTION OF MEDIA SPEED

CROSS REFERENCE TO RELATED APPLICATIONS

This invention is related to U.S. patent application Ser. No. 08/375,754 filed on Jan. 20, 1995 for Kinematically Fixing Flex Circuit to PWA Printbar (Docket No. 191044-1), and U.S. patent application Ser. No. 08/376,320 filed on Jan. 20, 1995 for PWA Inkjet Print Element With Resident Memory (Docket No. 191041), which applications are incorporated herein by reference and made a part hereof. This invention also is related to U.S. Pat. No. 5,089,712, issued Feb. 18, 1992 for Sheet Advancement Control System Detecting Fiber Pattern of Sheet (Holland); column 2, line 54 to column 5, line 55 of which are incorporated herein by reference and made a part hereof.

BACKGROUND OF THE INVENTION

This invention relates generally to page-wide-array ("PWA") inkjet printing methods, and more particularly, to a method of using media velocity feedback to vary PWA inkjet nozzle timing.

A PWA inkjet printer includes a printer element defining a page-wide-array printhead with thousands of nozzles. For an 11 inch printhead printing at 600 dpi, there are at least 6600 nozzles along the printhead. Ink is delivered from a resident reservoir to a nozzle chamber of each nozzle. During operation, the printer element is fixed while a page is fed adjacent to the printhead by a media handling subsystem. When printing, a firing resistor within a nozzle chamber is activated so as to heat the ink therein and cause a vapor bubble to form. The vapor bubble then ejects the ink as a droplet. Droplets of repeatable velocity and volume are ejected from respective nozzles to effectively imprint characters and graphic markings onto a media sheet. The PWA printhead prints one or more lines at a time as the page moves relative to the printhead.

Previous inkjet printers have used scanning type pen bodies. The scanning type pen bodies scan across a page while the page is intermittently moved by a media handling subsystem. A PWA printer element is analogous to the pen body, but has more nozzles and is fixed. A PWA printer element includes more than 5,000 nozzles extending the length of a pagewidth, while that of a conventional pen body has approximately 100–200 nozzles extending a distance of approximately 0.15 to 0.50 inches.

One of the driving motivations for creating a page-wide-array printhead is to achieve faster printing speeds. In particular it is desirable that a PWA printhead run at a print speed approaching nozzle speed. Nozzle speed is the highest frequency at which a nozzle is capable of firing as limited by nozzle technology. Print speed is the frequency at which nozzles are fired during a print operation. Print speed typically is less than nozzle speed due to limitations in data handling (i.e., data throughput) and media handling. With more nozzles the PWA printer element should print much faster than a smaller scanning pen body. One challenge of page-wide-array printing is to assure that dot data is available at each nozzle in a timely fashion. With thousands more nozzles than a conventional scanning pen body, such data throughput challenge is significant. The commonly-assigned patent application, "PWA Inkjet Printer Element with Resident Memory," referenced above and included herein by reference, addresses the data throughput problem by including memory on the printbar.

This application addresses an aspect of the media handling problem. Print speed often is compromised by the media transport system. For example, for printing with conventional scanning pen bodies, a media sheet is moved into position and stopped. Then the pen body scans the media to print a line of dots. The media sheet then is moved slightly along the media path to a new position. The pen body then scans the media again to print another line of dots. The cycle repeats for the entire print operation. One approach for improving print speed is to move the media while dots are printed. In particular, one approach would be to print while the media sheet moves at a constant velocity. Under such approach, however, there is a delay while the media sheet accelerates from rest up to the constant velocity. In addition, the media path would need to be longer to provide a path during the acceleration. Accordingly, there is a need for a printer element that can print with desired accuracy onto a media sheet moving at either a constant or non-constant velocity.

SUMMARY OF THE INVENTION

According to the invention, a page-wide-array ("PWA") printer element prints dots while a media sheet is in motion. A media sheet is moved from a stack along a media path by a media handling subsystem. As the sheet moves adjacent to the PWA printhead, nozzles are fired to eject ink droplets onto the media sheet.

According to one aspect of the invention, firing of printhead nozzles is controlled as a function of media speed. A media sheet accelerates from rest up to a known substantially constant velocity. Nozzles are fired while the media sheet accelerates and continue to fire while the media sheet moves at constant velocity. Nozzle timing is adjusted during acceleration to achieve accurate dot placement on the media sheet.

According to another aspect of the invention, nozzle timing has a "rated" timing for firing nozzles while the media sheet moves at a rated "constant" velocity. The rated constant velocity is the constant velocity achieved by the media sheet while moving along the media path. Variations in actual velocity relative to the rated velocity are used to adjust nozzle timing.

According to another aspect of the invention, a sensor is fixed relative to a PWA printer element for detecting a media sheet's actual velocity. Actual velocity is compared to the rated velocity. If actual velocity is slower than the rated velocity, then nozzle timing is adjusted to be slower than the rated timing. If actual velocity is faster than rated velocity, then nozzle timing is adjusted to be faster than the rated timing. As a media sheet is transported from a media stack then along a media path, its velocity typically accelerates from 0 up to the rated velocity, then remains at the rated velocity. Thus, the timing initially is adjusted to be substantially slower than the rated timing. Gradually the timing is increased to approach the rated timing. For a reliable media transport system, the media sheet will consistently reach and maintain the same constant velocity, (i.e., the rated velocity). Thus, in practice the timing is adjusted to reach, then hold at the rated timing.

According to another aspect of the invention, the actual velocity is sensed accurately enough for the adjusted timing to control dot printing within a ¼ dot tolerance error. For 600 dpi resolution, ¼ dot tolerance is $1/2400$ inches. For 600 dpi resolution, velocity measurements sampled at lower than 30 kHz correct the nozzle timing often enough for printing within the ¼ dot tolerance.

One advantage of the invention is that previous down time while starting and stopping a media sheet is avoided. Another advantage is that down time while waiting for the media sheet to reach a constant velocity is avoided. The PWA printhead nozzle timing is adjusted to prim while the media sheet is moving, and even while the media sheet accelerates up to a constant velocity. Another advantage is that the media path can be shorter because the printer element can be positioned closer to the paper stack. A beneficial effect is that the footprint can be smaller (e.g., approximately 17 inches instead of 28 inches).

These and other aspects and advantages of the invention will be better understood by reference to the following detailed description taken in conjunction with the accompanying drawings.

BRIEF DESCRIPTION OF THE DRAWINGS

FIG. 2 is a nozzle group of the PWA printer element of FIG. 1;

FIG. 3 is a nozzle structure of a nozzle of FIG. 2;

DESCRIPTION OF SPECIFIC EMBODIMENTS

Inkjet PWA Printer Element

Figure 1:
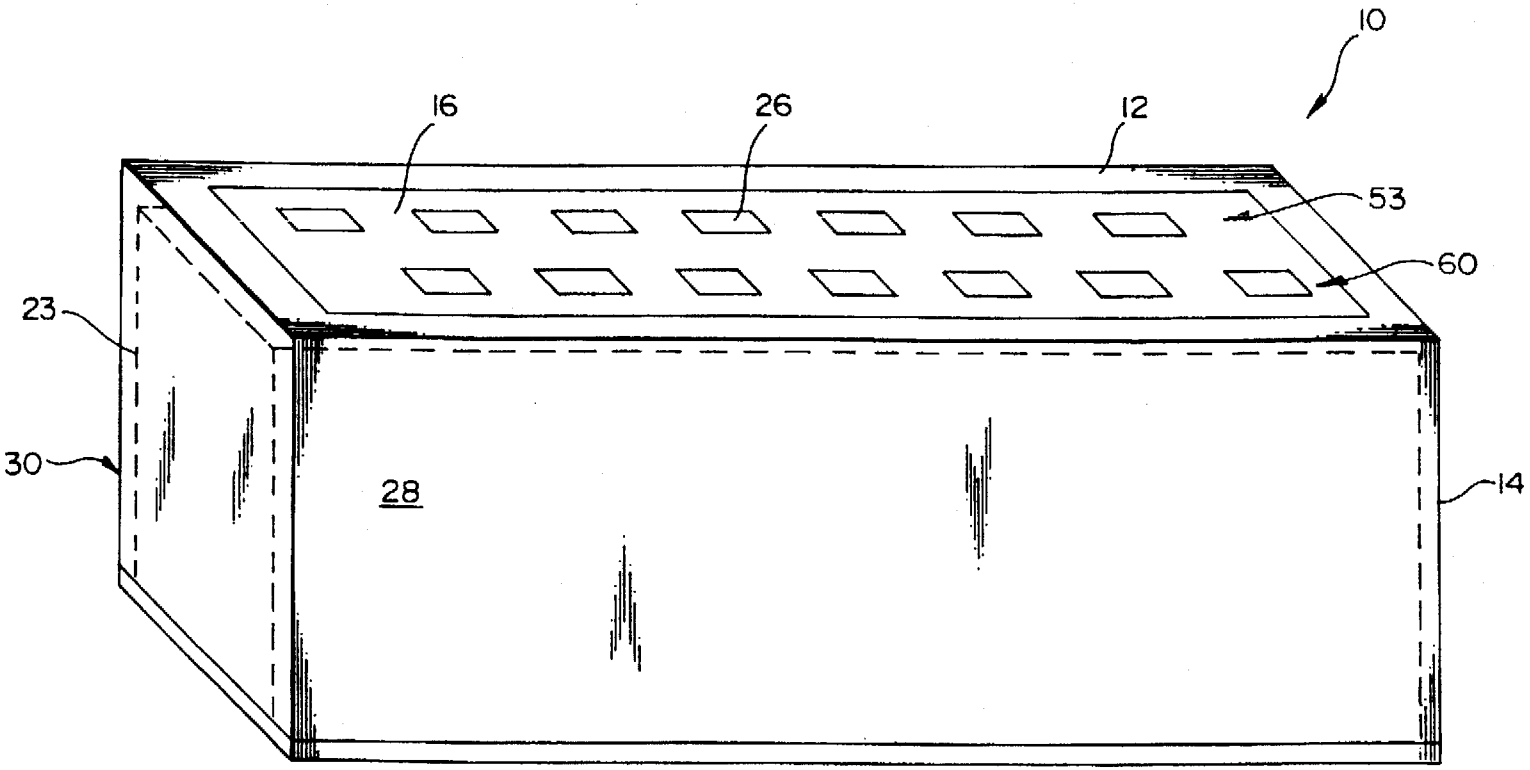
FIG. 1 is a perspective view of a page-wide-array ("PWA") printer element.

FIG. 1 shows an inkjet page-wide-array ("PWA") printer element 10. The printer element 10 extends at least a pagewidth in length (e.g., 8.5", 11" or A4) and ejects liquid ink droplets onto a media sheet. When installed in an inkjet printer, the printer element 10 is fixed. The media sheet is fed adjacent to a printhead surface 12 of the printer element 10 during printing. As the media sheet moves relative to the PWA printhead 12, ink droplets are ejected from printhead nozzles 44 (see FIGS. 2 and 3) to form markings representing characters or images. The PWA printhead 12 prints one or more lines of dots at a time across the pagewidth. The printhead 12 includes thousands of nozzles 44 across its length, but only select dots are activated at a given time to achieve the desired markings. A solid line for example, would be printed using all nozzles located between the endpoints of such line. In one embodiment an 11 inch printhead with 600 dpi resolution has at least 6600 nozzles.

Figure 7:
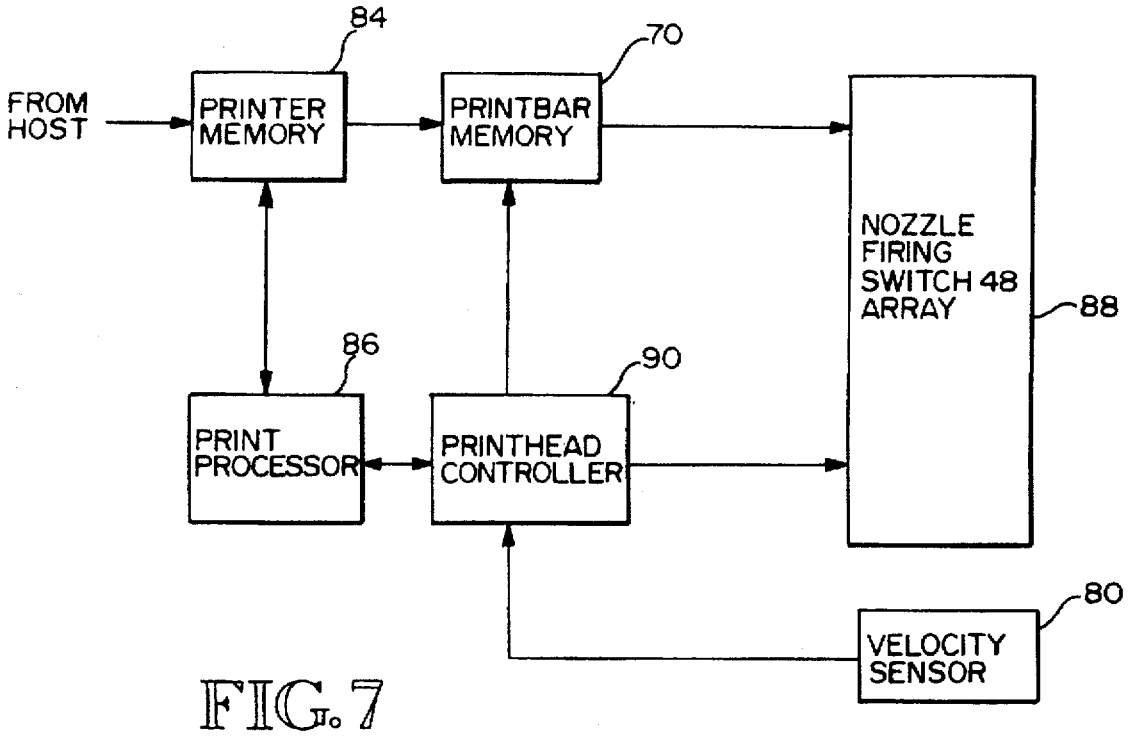
FIG. 7 is a block diagram of printer electronics embodying the velocity feedback method according to one embodiment of this invention.

In one embodiment the printer element 10 includes a printbar 14, a flexible printed circuit ("flex circuit") 16, and nozzle circuitry (FIGS. 3 and 7). The printhead 12 is formed by a first surface 22, the nozzle circuitry and the flex circuit 16. The printbar 14 serves as the printer element 10 body to which the other components are attached. In one embodiment the printbar 14 is approximately 12.5" by 1" by 2.5" and defines the first surface 22 to be approximately 12.5" by 1". The printbar 14 also defines an internal chamber 23 for holding an ink supply. In some embodiments the chamber 23 serves as a resident reservoir connected to an external ink source located within the printer but separate from the printer element 10.

Attached to the printbar 14 at the first surface 22 is the flex circuit 16. The flex circuit 16 is a printed circuit made of a flexible base material having multiple conductive paths and a peripheral connector. Conductive paths run from the peripheral connector to various nozzle groups 26 and from nozzle group 26 to nozzle group 26. In one embodiment the flex circuit 16 is formed from a base material made of polyamide or other flexible polymer material (e.g., polyester, poly-methyl-methacrylate) and conductive paths made of copper, gold or other conductive material. The flex circuit 16 with only the base material and conductive paths is available from the 3M Company of Minneapolis, Minn. The nozzle groups 26 and peripheral connector then are added. The flex circuit 16 is coupled to off-circuit electronics via an edge connector or button connector.

FIG. 2 is a diagram of a nozzle group 26. Each nozzle group 26 includes two rows 40, 42 of printhead nozzles 44. Flex circuit conductors meet with nozzle group conductors to define a circuit path. In one embodiment for an 11 inch printhead 12 with 600 dpi resolution, there are 32 nozzle groups 26, and sixteen groups 26 per row 53, 60. Each group extends approximately 0.5 inches and is offset from adjacent groups 26 in the other row. Each nozzle group includes two rows 42, 44 of printhead nozzles 44. Each row includes at least 150 printhead nozzles 44. The nozzles 44 in a given row 42(44) are staggered or precisely aligned. Further the nozzles 44 in all rows 42(44) for all nozzle groups 26 of a row 53(60) are staggered or precisely aligned. Thus, there are four lines of nozzles 44 on the printhead 12 used for printing one line of approximately 6600 dots.

In one embodiment, the substrate 49 defines memory and nozzle circuitry. The memory is loaded with dot data from off-circuit print memory (e.g., memory on print process or board or an add-in card). The nozzle circuitry includes a switch for receiving a firing signal from the memory. When the firing signal is active the switch excites a resistor, which in turn heats up ink within a nozzle chamber. Some of the ink vaporizes. Some of the ink is displaced so as to be ejected a droplet having a known repeatable volume and shape.

FIG. 3 shows a printhead nozzle 44 loaded with ink I. In one embodiment a silicon substrate 49 with additional layers defines one or more nozzle groups 26 attached to the printbar 14 and flex circuit 26. A nozzle 44 receives ink I from a printbar reservoir via a channel 54. The ink flows into a nozzle chamber 52. The nozzle chamber 52 is defined by a barrier film 56, a nozzle plate 58 and a passivation layer 60. Additional layers are formed between the substrate 49 and passivation layer 60, including insulative layers 62, 64, another passivation layer 66 and a conductive film layer 68. The conductive film layer 68 defines a firing resistor 50.

In one embodiment the nozzle plate 58 is mounted to the flex circuit 26 with the nozzle circuitry. In another embodiment the flex circuit forms the nozzle plate 58. According to the flex circuit embodiment for the nozzle plate 58, respective orifices are laser drilled to achieve a precise area, orientation and position relative to the nozzle chambers 52. The nozzle orifice has a uniform diameter for each nozzle. In various embodiments the nozzle orifice is 10–50 microns in diameter.

The substrate 49 typically defines nozzle and memory circuitry for several nozzles. In one embodiment a substrate defines nozzle and memory circuitry for a given nozzle group 26. In another embodiment a substrate defines the same for multiple nozzle groups 26 (e.g., all groups 26; all groups 26 in a row 53, 60; some groups in one or more rows 53, 60).

Media Handling and Velocity Sensor

Figure 4:
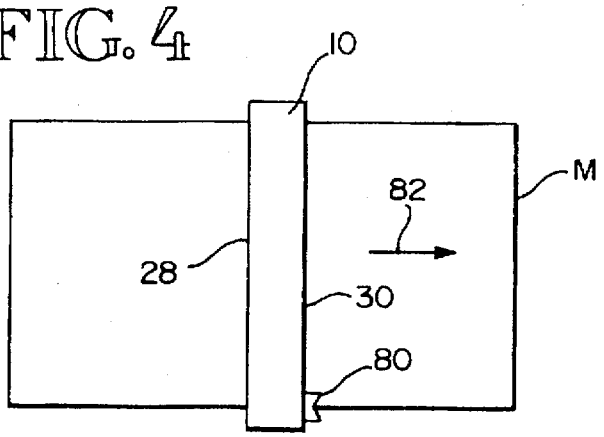
FIG. 4 is planar view of a media sheet moving relative to a PWA printhead and velocity sensor according to one embodiment of this invention.
Figure 5:
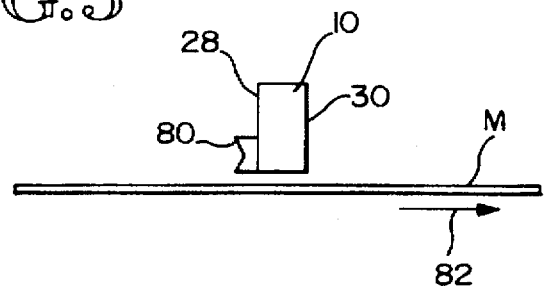
FIG. 5 is planar view of a media sheet moving relative to a PWA printhead and velocity sensor according to another embodiment of this invention.
Figure 6:
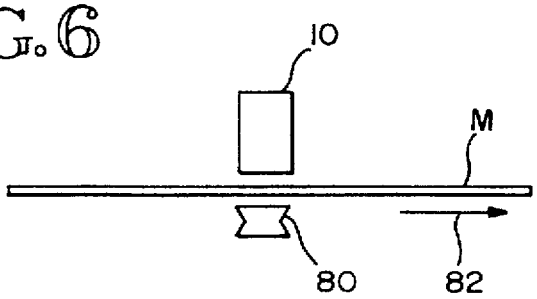
FIG. 6 is planar view of a media sheet moving relative to a PWA printhead and velocity sensor according to yet another embodiment of this invention.

FIGS. 4–6 show a media sheet M moving relative to the PWA printer element 10 and velocity sensor 80 in a transport direction 82 according to three alternate embodiments of this invention. In the embodiment shown in FIG. 4, the sensor 80 is positioned on the printer element 10 at side 30 so that the sensor 80 detects the velocity of the media sheet M as it passes beyond the element 10. In the embodiment shown in FIG. 5, the sensor 80 is positioned on the printer element 10 at side 28 so that the sensor 80 detects velocity of the media sheet M as it first encounters the printer element 10. In the embodiment shown in FIG. 6, the sensor 80 is mounted apart from the printer element 10 at a position directly beneath the printer element 10. The media sheet travels between the sensor 80 and printer element 10 so that sensor 80 detects the velocity of the media sheet M as the sheet M passes below the nozzle groups 26.

According to one embodiment of the invention the velocity sensor 80 is an electro-optic paper positioning sensor or sensor array adapted for deriving the rate of media movement. Such optical sensor(s) are described in U.S. Pat. No. 5,089,712, issued Feb. 18, 1992 for Sheet Advancement Control System Detecting Fiber Pattern of Sheet; and U.S. Pat. No. 5,149,980 issued Sep. 22, 1992 for Substrate Advance Measurement System Using Cross-Correlation of Light Sensor Array Signals. The sensor(s) 80 include a respective light source and light detector. The sensor looks at the media fiber, then develops a signature, then monitors the movement of the signature.

According to various optical sensor embodiments, exemplary light sources include a photo-emitter, LED, laser diode, super luminescent diode, or fiber optic source. Exemplary light detectors include a photo-detector, charged couple device, or photodiode. The light source is oriented to emit a light beam in a specific direction relative to the printer element 10. The light detector is aligned to detect light reflected from the media sheet.

Dot Data

During a normal print job, image data, text data or data of another format is output from a host computer to printer memory 84 (See FIG. 7) of a PWA inkjet printer. A print processor 86 converts the received data into "dot data." Dot data as used herein means a data format corresponding to the dot pattern to be printed to achieve media sheet markings corresponding to given input data. Dot data for a given nozzle 44 is one bit having a first logic state indicating the nozzle is to fire ink or a second logic state indicating the nozzle is not to fire ink. The dot data defines lines of output dots. Each line of dot data corresponds to the firing state of each of the approximately 6600 nozzles for a given time. A current dot line will have approximately 6600 entries with between 0 and 6600 of the entries having a first logic state indicating to fire a corresponding nozzle. If all 6600 entries are at the first logic state, then a solid line is printed. If 1 or more but less than the 6600 entries have a first logic state, then the printed output appears as a dot, one or more line segments and/or dots, or a lighter line.

For a 6600 nozzle embodiment, dot data for 6600 entries or more are periodically transferred from printer memory to printbar memory 70 according to a serial or parallel data transfer protocol. In one embodiment memory 70 stores one line at a time. In other embodiments, memory 70 has look-ahead capacity for storing multiple lines at a time. Dot data from printbar memory 70 then is output to the flex circuit 16 and nozzle groups 26 to activate nozzles 44. In particular the dot data are input to an array 88 of firing switches. In one embodiment, dot data is output in pluralities to address a plurality of nozzles 44 at a time (e.g., nozzle group by nozzle group or another addressing scheme for selecting less than all nozzles at a time).

In one embodiment printer element 10 lacks printbar memory 70. For such embodiment, dot data is transferred directly from printer memory 84 to the flex circuit 16 and nozzle groups 26 (e.g., switch array 88) to address pluralities of nozzles 44. In another embodiment printer element 10 includes memory 70 positioned on the printbar 14. Dot data is received from print memory 84, then output from printbar memory 70 to the firing switch array 88 preferably in parallel multiplexed fashion.

Nozzle Timing

A printhead controller 90 defines the timing for activating switches of array 88, and thus, for firing nozzles 44. In one embodiment, the controller 90 is timing circuitry on the flex circuit 16, substrate 49 or printbar 14. In another embodiment the controller 90 is embodied by the print processor 86. The printhead controller 90 determines timing for transferring data from printer memory 84 into printbar memory 70 and from printbar memory 70 to the switch array 88. In the embodiment without printbar memory 70, print controller 90 determines timing for transferring data from printer memory 84 to the switch array 88.

According to one method for firing switches in array 88, the switches first are disabled. Dot data for select nozzles 44 then are output to the array 88. The corresponding switches then are enabled causing the switches to drive their corresponding firing resistors 50. The firing resistors 50 heat the ink within respective nozzle chambers 52 causing ink droplets to be fired. The switches then are disabled. The cycle then repeats for another set of nozzles 44 until all nozzles have been addressed. The process repeats for all the nozzles 44 again and again as the print job continues. Such process typically occurs at a "set" frequency during a print job. However, according to the method of this invention, the frequency is adjustable.

The set frequency defines a rated timing. Such rated timing is derived for a known constant velocity of paper motion relative to the printer element 10. Such known constant velocity is referred to herein as a rated velocity. Exemplary rated constant velocities range from 1 page per minute upward. Speeds are of 1 inch per second to 100 inches per second are typical. In one embodiment controller 90 generates timing signals for the approximately 6600 nozzles 44 at an approximately 20 kHz nozzle speed. To be within a ¼ dot tolerance all 6600 nozzle are addressed within 12.5 microseconds. In a specific embodiment, a set of 30 nozzles is addressed at a time. Different sets are addressed in sequence until all 6600 nozzles have been addressed within the 12.5 microseconds. To achieve such addressing a transfer rate from printbar memory 70 to switch array 88 of $^{3}$17.6 MHz (i.e., 4.4 MHz×4) is used. By increasing the number of nozzles in a set, and thus addressed at one time, the 17.6 MHz rated timing can be reduced while still maintaining a 20 kHz nozzle speed and ¼ dot tolerance error.

Velocity Feedback

According to the velocity feedback method of this invention, media sheet M velocity is detected and compared to the rated constant velocity. Sensor 80 periodically samples the media sheet M velocity to maintain print accuracy within a ¼ dot tolerance for a print speed equal to the nozzle speed (e.g., 20 kHz). An acceptable range of sampling rate varies according to print speed and media transport motor linearity. For a very fast print speed of 100 inches per second the maximum needed sampling rate for a motor with no more than 1% velocity variation in 0.003 seconds is 30 kHz. Thus, sampling at more than 30 kHz is effective for typical low cost transport motors and very fast print speeds. As print speed typically is lower and motor linearity truer, other embodiments may use slower sampling rates. Because a sampling frequency of 30 kHz or less is such a small processing burden faster sampling rates are used in many embodiments.

The sampled sheet M velocity is input to the print controller 90. The print controller 90 compares the measured "actual" velocity to the "rated" constant velocity. The rated constant velocity is the known velocity used for defining the normal or rated timing signal frequency. For actual velocities less than the rated velocity the frequency of the timing signal is decreased. The adjusted frequency is determined by the relationship (I) below:

$$f_1/f_0=v_1/v_0 \quad \text{(I)}$$

where $f_1$=adjusted frequency;

$f_0$=rated frequency;

$v_1$=actual velocity; and $v_0$=rated velocity.

Rated frequency and rated velocity are known. Actual velocity is measured. Thus, adjusted frequency is derived. In one embodiment, the print controller 90 includes an adjustable clock with a programmable delay line defining the clock frequency. The delay is varied according to the outcome of relationship (I). In one embodiment, a change in delay time is derived from the derived frequency and the rated frequency based upon the relationship (II) below:

$$\text{delta } t=t_1-t_0 \quad \text{(II)}$$

where $t_0$=delay for rated frequency; and $t_1=t_0*(f_1/f_0)$.

Typically, a media sheet M is picked from a media stack and moved along a media path by a media transport subsystem. Such a transport subsystem typically includes a series or drive rollers along with a biasing element for pressing the sheet M to the rollers. A transport motor runs the drive rollers. The media sheet M accelerates from rest up to a constant velocity. Such constant velocity is consistent from cycle to cycle and serves as a rated velocity for the PWA printer. Because the printhead prints while the media sheet is moving, the rated velocity is used to define a rated timing signal so that dots are accurately placed on the media sheet M. According to the method of this invention, printing can occur even while the media sheet M is accelerating or moving at other than the rated velocity. Actual velocity is measured and used to adjust the timing so that dots still are accurately placed on the media sheet M.

Meritorious and Advantageous Effects

One advantage of the invention is that down time while waiting for the media sheet to speed up to a constant velocity is avoided. The PWA printhead nozzle timing is adjusted to print while the media sheet accelerates to the constant velocity. Thus, the time to complete a print job is less. Another advantage is that the media path can be shorter because the printer element can be positioned closer to the paper stack. A beneficial effect is that the footprint can be smaller (e.g., approximately 17 inches instead of 28 inches).

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for adjusting a timing signal that controls nozzle firing for a page-wide-array printer element, comprising the steps of:

accelerating a media sheet from rest up to a constant velocity approximating a rated velocity as the media sheet moves along a media path, the media sheet increasing velocity while a page-wide-array printhead of nozzles ejects ink onto the media sheet;

generating a timing signal for addressing a first plurality of nozzles on the page-wide-array printhead of nozzles, at least one of the addressed nozzles ejecting ink onto the media sheet;

detecting actual velocity of the media sheet in the vicinity of the printhead with a velocity sensing apparatus; and periodically adjusting frequency of the timing signal as a function of the actual velocity and the rated velocity, wherein the rated velocity is fixed.

2. The method of claim 1 in which the velocity sensing apparatus is positioned on the printer element upstream from the printhead relative to the media path.

3. The method of claim 1 in which the velocity sensing apparatus is positioned on the printer element downstream from the printhead relative to the media path.

4. The method of claim 1 in which the velocity sensing apparatus and printer element are aligned along the media path so that actual velocity is sampled for a portion of the media sheet passing adjacent to the printhead, such portion passing between the velocity sensing apparatus and printhead.

5. An apparatus for adjusting a nozzle timing signal while a media sheet accelerates along a media path up to a constant velocity approximating a rated velocity, the media sheet increasing velocity while a page-wide-array printhead of nozzles ejects ink onto the media sheet, the apparatus comprising:

a velocity sensor for detecting actual velocity of the media sheet in the vicinity of the printhead;

a timing generator for defining a timing signal for activating at least one of a first plurality of the page-wide-array of nozzles to eject ink onto the media sheet; and means for periodically adjusting frequency of the timing signal as a function of the actual velocity and the rated velocity, wherein the rated velocity is fixed.

6. The apparatus of claim 5 in which the velocity sensing apparatus is positioned upstream from the printhead relative to the media path.

7. The apparatus of claim 5 in which the velocity sensing apparatus is positioned downstream from the printhead relative to the media path.

8. The apparatus of claim 5 in which the velocity sensing apparatus and printhead are aligned along the media path so that actual velocity is sampled for a portion of the media sheet passing adjacent to the printhead, such portion passing between the velocity sensing apparatus and printhead.

9. A page-wide-array inkjet printing apparatus for adjusting a nozzle timing signal while a media sheet accelerates along a media path up to a constant velocity approximating a rated velocity, the media sheet increasing velocity while a page-wide-array printhead of nozzles ejects ink onto the media sheet, the apparatus comprising:

an elongated printbar for defining a printbar chamber for holding ink and defining a first surface;

a plurality of nozzle circuits, each one of said nozzle circuits defining a nozzle chamber for receiving ink from the printbar chamber and a firing resistor within the nozzle chamber;

a flex circuit defining a plurality of conductive paths, wherein the plurality of nozzle circuits are attached to the flex circuit and wherein each one of the conductive paths is electronically coupled to a firing resistor of a corresponding one of the nozzle circuits, and wherein the flex circuit with attached nozzle circuits are attached to the first surface of the printbar to define the page-wide-array printhead of nozzles;

memory for storing dot data for each one of the printhead nozzles, wherein dot data for each one of the printhead nozzles is output from memory to the firing resistor of a corresponding one of the printhead nozzles;

a velocity sensor for detecting actual velocity of the media sheet in the vicinity of the printhead;

a timing generator for defining a timing signal for activating one or more of a first plurality of the printhead nozzles to eject ink onto the media sheet; and means for periodically adjusting frequency of the timing signal as a function of the actual velocity and the rated velocity, wherein the rated velocity is fixed.

10. The apparatus of claim 9 in which the velocity sensing apparatus is positioned on the printer element upstream from the printhead relative to the media path.

11. The apparatus of claim 9 in which the velocity sensing apparatus is positioned on the printer element downstream from the printhead relative to the media path.

12. The apparatus of claim 9 in which the velocity sensing apparatus and printer element are aligned along the media path so that actual velocity is sampled for a portion of the media sheet passing adjacent to the printhead, such portion passing between the velocity sensing apparatus and printhead.

* * * * *